United States Patent [19]

Havlik

[11] 4,055,345

[45] Oct. 25, 1977

[54] GAME APPARATUS

[76] Inventor: Vaclav Havlik, 888 Foster City Blvd., Foster City, Calif. 94402

[21] Appl. No.: 625,185

[22] Filed: Oct. 23, 1975

[51] Int. Cl.[2] ..... A63F 3/02

[52] U.S. Cl. ..... 273/131 AC; 273/136 E; 273/136 G; 273/136 H; 273/137 AC

[58] Field of Search ..... 273/130 AC, 130 B, 131 AC, 273/136 E, 136 B, 136 H, 136 G, 137 AC

[56] References Cited

U.S. PATENT DOCUMENTS

| | | | |
|---|---|---|---|
| 163,601 | 5/1875 | Morgan | 273/136 E |
| 2,123,758 | 7/1938 | Wentzel | 40/140 |
| 3,021,140 | 2/1962 | Lushansky | 273/130 B |

FOREIGN PATENT DOCUMENTS

| | | | |
|---|---|---|---|
| 474,018 | 3/1929 | Germany | 273/136 B |

*Primary Examiner*—Anton O. Oechsle
*Attorney, Agent, or Firm*—Phillips, Moore, Weissenberger, Lempio & Majestic

[57] ABSTRACT

A game board having opposed parallel major surfaces. The board is provided with a plurality of slots individually associated with a like plurality of playing fields. A plurality of game pieces each comprising a pair of indicia bearing bodies joined to each other at one of their ends are also provided. The board and pieces are so constructed as to enable the pieces to be disposed in respective slots with the indicia bearing bodies of each pieces extending in juxtaposed parallel relation to an opposed major surface of the board.

13 Claims, 22 Drawing Figures

GAME APPARATUS

BACKGROUND OF THE INVENTION

This invention relates to game apparatus including a game board having a planar surface comprising a plurality of playing fields arranged in an array of rows and columns together with a plurality of playing pieces adapted to be removably mounted on selected ones of the playing fields of such surface and more particularly to such game apparatus in which at least every other one of the playing fields of at least each column is associated with an opening extending all the way through the board between it and an adjacent playing field and the playing pieces are removably mounted on playing fields of the board by means of such openings.

Games based on a planar surface divided into a plurality of playing fields arranged in rows and columns such as checkers, chess, tic-tac-toe, etc. have been known from earliest times. In such games a plurality of marks or more often physically discrete markers or playing pieces are each placed on a selected one of the playing fields in order to play the game. Thus, the planar surface or "checkerboard" is normally oriented substantially horizontally and the playing pieces merely rest on the playing fields and are easily displaced with respect thereto.

Game apparatus of this type in which the "checkerboard" is oriented vertically have been proposed in which case some means for mounting the playing pieces on the playing fields of the board must be provided. For example, the prior art discloses game apparatus comprising a checkerboard having a plurality of hooks projecting from the planar surface thereof adjacent selected playing fields thereof and apertured playing pieces adapted to be hung from such hooks over such playing fields. Similarly, the prior art disclose game apparatus which comprises a checkerboard having a plurality of holes or slots in the planar surface thereof each located in one of the playing fields thereof and a plurality of playing pieces each having a projection thereon adapted to engage such holes or slots.

Such vertical game apparatus has a number of advantages. The playing board may be made larger, since the "reach" of the player's arms is not a limitation. In addition, the game board is easier for the players to "read" both due to size and orientation. Also, the playing pieces cannot be accidentally displaced. However, the players of such apparatus tend to get in each other's way since they must both be on the same side of the vertical game board during play.

It is an object of this invention to provide a game apparatus of the type described above in which the players may play the game from opposite sides of the game board when the playing surface thereof extends vertically.

Game apparatus is known in which the playing field thereof comprise openings through the game board arranged in rows and columns and the playing pieces are adapted to fit through the openings so that the game may be played with the game board oriented vertically with the players on opposite sides thereof.

However, in this type of game apparatus either the "checkerboard" feature is sacrificed since all of the playing fields are openings which tend to be indistinguishable from each other or the size of the game pieces relative to the playing fields must be reduced. Thus, in games such as chess, it is either difficult to locate a particular desired playing field of the array or to "read" the values of the game pieces.

It is another object of this invention to preserve the checkerboard feature and size of the game pieces relative to the playing fields in game apparatus of the type described.

Obviously, a two-sided vertical checkerboard array of playing fields could be provided with projections on both sides for mounting playing pieces. However, this would require each player to duplicate his moves on both sides of the playing board or some sort of cooperation between the players to cause each move to be presented on both sides of the board.

It is a further object of this invention to provide game apparatus of the type described in which each move by a player on one side of the playing board is automatically reproduced on the other side of the playing board without diminishing the checkerboard feature of the playing board.

The prior art discloses a two-sided vertical board for playing chess or checkers in which the rows of playing field are oriented horizontally in spaced parallel planes to provide shelves on which the playing pieces are placed. Similarly, the prior art discloses a checkerboard array of openings with each opening provided with a shelf on which playing pieces are placed. In the first case the checkerboard feature of the apparatus is greatly reduced. In the second case it is impossible to play chess since only the checkerboard array of openings are available for play, whereas contiguous playing fields in each row are required for chess. In both cases the playing pieces may be easily displaced from their desired position on the shelves in play.

It is yet another object of this invention to provide game apparatus of the type described in which all playing fields of the board are available for play and in which the playing pieces cannot be accidentally displaced from their selected position on the board, without sacrifice of the checkerboard feature thereof.

SUMMARY OF THE INVENTION

The game board of game apparatus according to this invention includes means mounting a plurality of playing fields in row and column array with at least every other one of the playing fields in each row and column of such array being associated with an opening extending all the way through the board between it and an adjacent playing field in its column of the array which opening has a maximum dimension in the direction of such column which is a small part of the maximum dimension of the playing field in the direction of such column when the playing board is oriented with the direction of the column extending vertically. The game apparatus of this invention also includes a plurality of game pieces each of which comprises a pair of indicia bearing bodies and means joining such pair of bodies to each other at one of their ends with the bodies extending in mutually parallel planes. According to this invention, at least the means of the game board mounting the plurality of playing fields in row and column array or the means of each game piece joining the pair of bodies thereof to each other at one of their ends is sufficiently flexible to allow one of the pair of bodies of each of said game pieces to engage any one of the openings associated with a playing field whereby the game piece may be supported in selected juxtaposition with respect to the playing field.

BRIEF DESCRIPTION OF THE DRAWING

The foregoing and other objects and features of this invention will be more fully understood from the following detailed description of preferred embodiments thereof when read in conjunction with the drawing wherein.

DETAILED DESCRIPTION OF PREFERRED EMBODIMENTS

Figure 1:
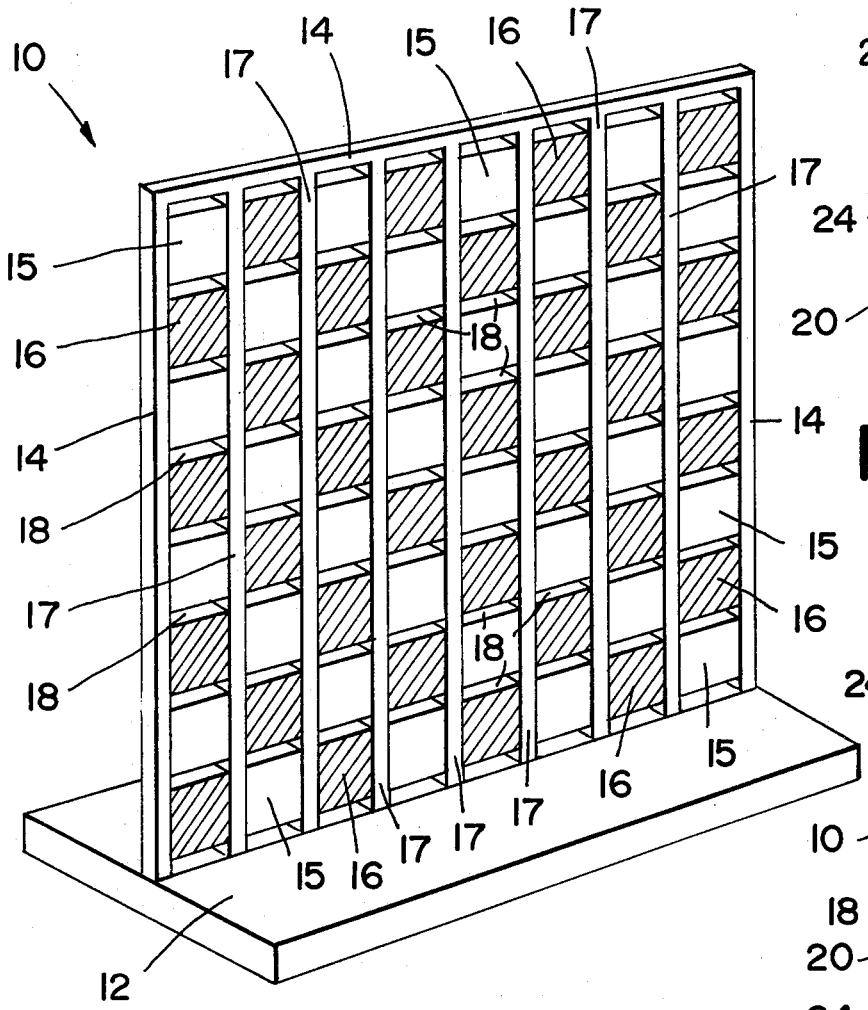
FIG. 1 is a perspective view of a game board in accordance with one preferred embodiment of this invention oriented for play in a vertical position by players on opposite sides thereof.

Referring to FIG. 1, a game board 10 according to one embodiment of the game apparatus of this invention is shown. According to this embodiment of the invention, the game board 10 is essentially rigid and may be rigidly supported in a vertical position by means of an appropriate pedestal 12. The game board 10 comprises a rigid frame 14 within which a plurality of rigid squares of two different colors for example, white 15 and black 16, are mounted by means of vertically extending rigid rods 17 in a checkerboard array of horizontal rows or ranks and vertical columns or files. The squares or different colored playing fields 15 and 16 of each vertical column or file are spaced from each other by a distance which is a small part of the transverse dimensions thereof to provide a plurality of openings 18 which extend all the way through the board 10. The playing fields 15 and 16 may be made of squares of white and black plastic respectively, for example, thereby presenting identical checkerboard arrays on opposite vertical faces of the playing board 10 with an opening at each side of each playing field in each column or file. The frame 14 and rods 17 may be made of transparent plastic to which the playing fields 15 and 16 may conveniently be glued to provide a playing board 10 of pleasing appearance.

Figure 2:
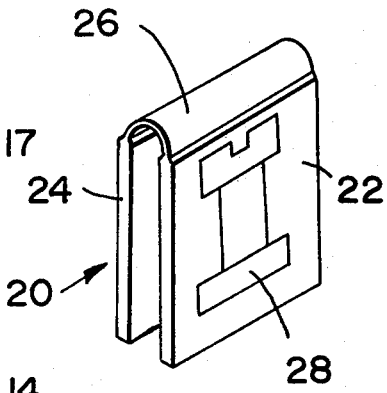
FIG. 2 is a perspective view of a game piece particularly adapted for use with the game board of FIG. 1 in a preferred embodiment of the game apparatus of this invention.

Referring to FIG. 2, a game piece 20 for use with the game board 10 according to this embodiment of the game apparatus of this invention is shown in enlarged perspective view. Such game piece 20 comprises two substantially rigid generally square planar bodies 22 and 24 having dimensions somewhat smaller than the dimensions of the playing fields 15 and 16 of the board 10 joined to each other along one of their edges by a flexible member 26. Thus, when the game piece 20 is supported by the flexible member 26, the bodies 22 and 24 thereof will lie in generally parallel spaced planes. Each of the bodies 22 and 24 is transparent and is provided with appropriate indicia 28 on the exterior surface thereof for use in play using the game apparatus of this invention.

Figure 3:
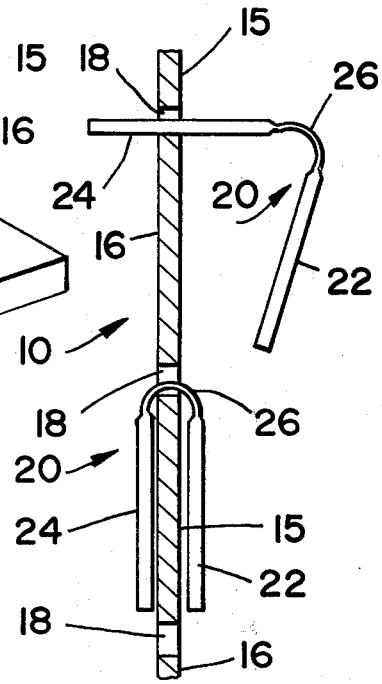
FIG. 3 is a fragmentary cross-sectional view of the game board of FIG. 1 together with two game pieces as shown in FIG. 2 with one of such game pieces shown in the process of being engaged with the game board and the other of such game pieces shown fully engaged with the game board.

Referring to FIG. 3, an enlarged fragmentary cross-sectional view of the game board 10 of FIG. 1 is shown together with cross-sectional views of two playing pieces 20, one of which is shown already assembled onto the board 10 and the other of which is shown in the process of being assembled onto or removed from the board 10. Thus, at the top of FIG. 3, the flexible member 26 of the playing piece 20 is shown flexed to cause the rigid bodies 22 and 24 to extend in planes which are transverse to each other. One end of one of the bodies 24 is then inserted through one of the openings 18 between playing fields 15 and 16 in one of the vertical columns of the array thereof. As shown at the bottom of FIG. 3, when the game piece 20 is in its final position as assembled on the board 10, the flexible member 26 of the game piece 20 will be received in an opening 18 with the rigid bodies 22 and 24 of the game piece 20 depending therefrom on opposite sides of the playing field 15. In order to remove the game piece 20 from the board 10, the procedure is reversed by pulling one of the bodies 22 away from the board 10 thus withdrawing the other body 24 through the opening 18.

As shown and described in detail herein, the game board 10 and game pieces 20 are adapted for use in playing chess since each playing field of the game board 10 will be involved and since any game piece may be associated with any playing field at some time during play. A game such as checkers could also be played on the same game board 10 using appropriate game pieces 20. However, less than all of the playing fields would be involved in play. Similarly, other games such as tic-tac-toe could be played on a portion of the game board 10 and it will be understood that the game board 10 could be specifically adapted for still other games.

In playing chess or checkers on the game board 10 when oriented vertically as shown in FIG. 1, the players are on opposite sides of the game board 10 and thus tend to be visually isolated from each other. One of the players plays from the bottom of the game board upwardly and the other of the players plays from the top of the game board downwardly. Each player will see his opponent's moves but will not be distracted by his opponent's presence. The game board can, of course, be made larger than usual since the players are in effect positioned at the center of the board thus doubling their reach over the surface of the game board without inconvenience. The larger board and its vertical orientation make it easier for the players to "read" and the lack of distraction due to the presence of the other player enables each of the players to move fully consider their respective moves.

Figure 4:
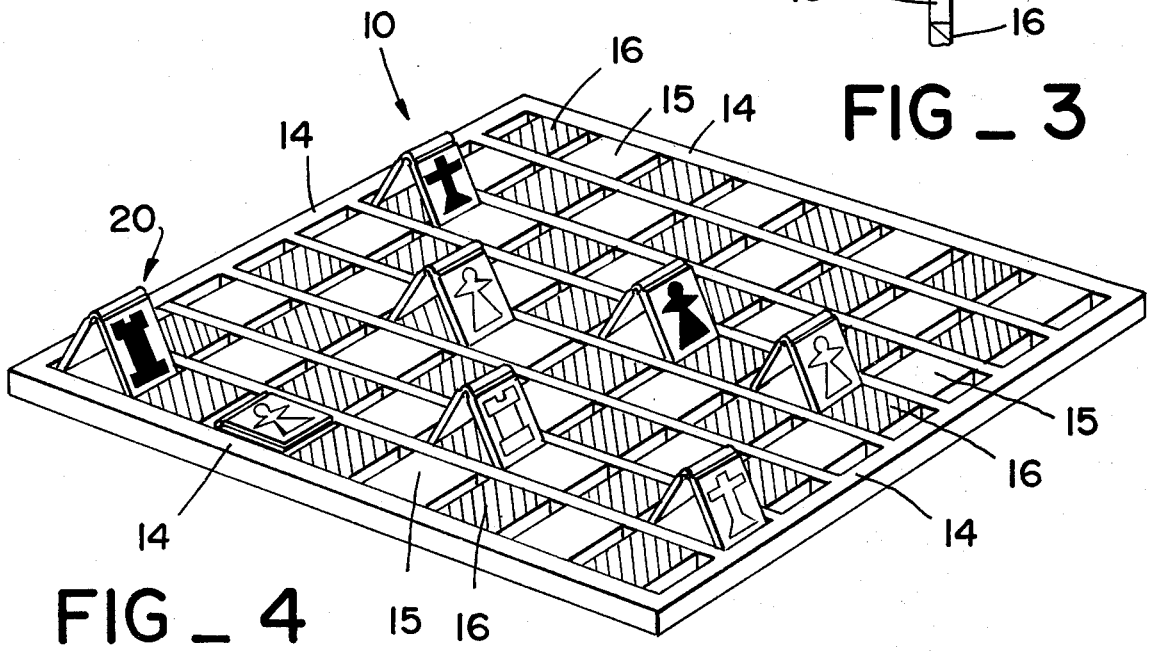
FIG. 4 is a perspective view of the game board of FIG. 1 but shown oriented for play in a horizontal position with a plurality of playing pieces arranged on the playing board and showing two alternative positions for the game pieces on the game board.

The game board 10 and the game pieces of the game apparatus according to the teaching of this invention can be used in a horizontal position as shown in FIG. 4. In the horizontal position, the game pieces 20 may either be placed in a tent fashion with the free ends of the two rigid bodies 22 and 24 engaging the openings 18 at opposite ends of a particular playing field. Alternatively, the game pieces may be folded flat and placed on the desired playing field as shown at the left in FIG. 4. However, when the game apparatus according to this embodiment of the invention is played in a horizontal position, as shown in FIG. 4, the game pieces thereof are susceptible to being accidentally moved or misplaced as in conventional game apparatus, whereas when the game apparatus according to this embodiment of the invention is played in a vertical position, the game pieces cannot be accidentally moved or misplaced. In fact, it would be possible for blind persons to use the game apparatus according to this embodiment of the invention by actually feeling the board for the placement and value of the various pieces. Thus, both blind players may simultaneously and continuously feel the board on their respective sides without interfering with each other or accidentally displacing the game pieces.

Figure 5:
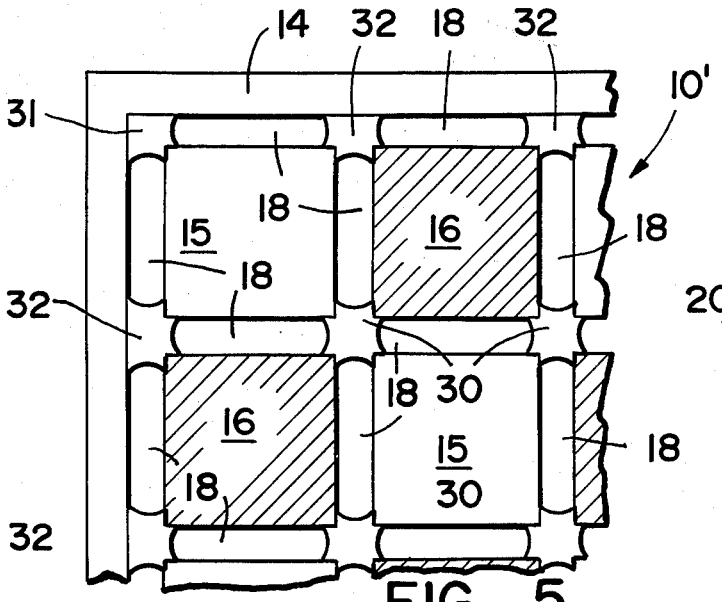
FIGS. 5, 6 and 7 are enlarged fragmentary front views in elevation each of the upper left hand corner of a game board similar to that shown in FIG. 1 but each showing a different construction for such game board.
Figure 6:
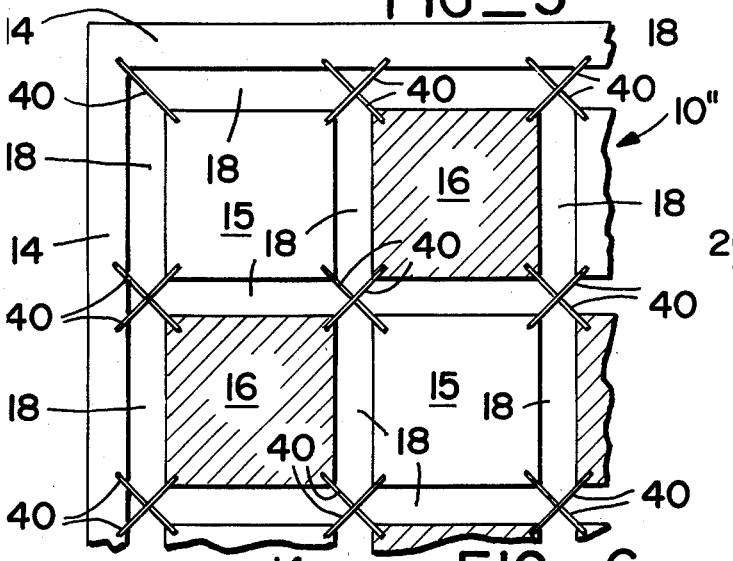
Figure 7:
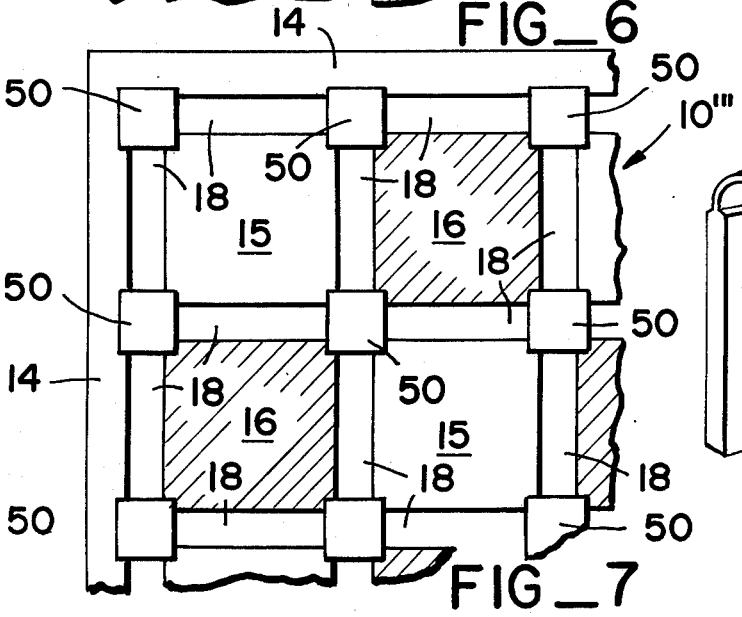

In its simplest form, a game board according to the teaching of this invention could be made of a unitary flat sheet having playing fields painted or otherwise applied to its opposite surfaces and slots cut therethrough between adjacent playing fields in order to accommodate the game pieces as described above. However, it has been found that a particularly pleasing game board results if the playing fields comprise rigid squares suitably mounted with respect to each other within the frame 14. FIGS. 5 through 7 show preferred constructions by which the playing fields 15 and 16 may be mounted within the frame 14.

Thus, in FIG. 5, a plurality of spacer members 30 are rigidly fixed between the corners of the playing fields 15 and 16 with similar spacer members 31 and 32 being interposed between the frame 14 and the corners of the playing fields 15 and 16 adjacent thereto. Thus, an opening 18 is provided along each side of each playing field 15, 16 and the game apparatus may be used with the game board oriented with any one of its sides uppermost.

In FIG. 6 a construction is shown in which the playing fields 15, 16 are hung within the frame by means of threads or wires 40 extending through holes provided at the corners of the playing fields 15 and 16. Similarly, as shown in FIG. 7, the playing fields 15 and 16 may be interconnected with each other and with the frame 14 by means of smaller rigid squares 50 glued or otherwise fastened to bridge between the corners of the playing fields 15 and 16, as shown. Thus, the required openings 18 are provided along the edges of the playing fields 15 and 16 in the constructions of FIGS. 6 and 7 as discussed in connection with FIG. 5.

Figure 8:
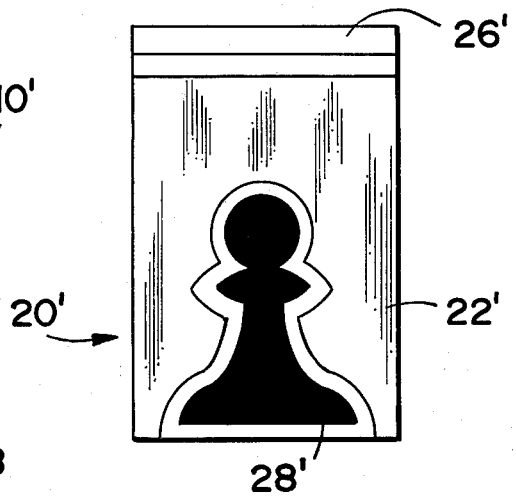
FIGS. 8 and 9 are enlarged front views in elevation of game pieces as shown in FIGS. 2–4 illustrating one system for applying indicia to the game pieces.
Figure 9:
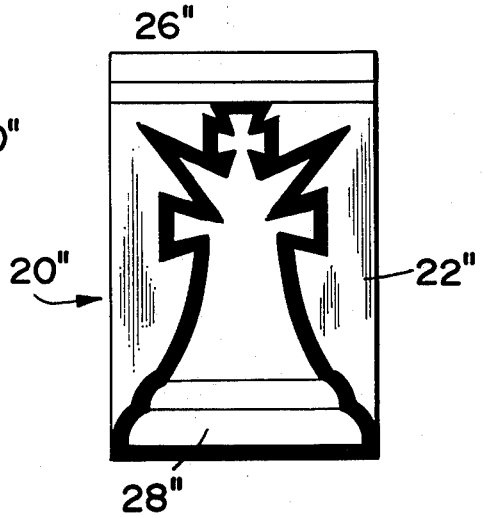
Figure 10:
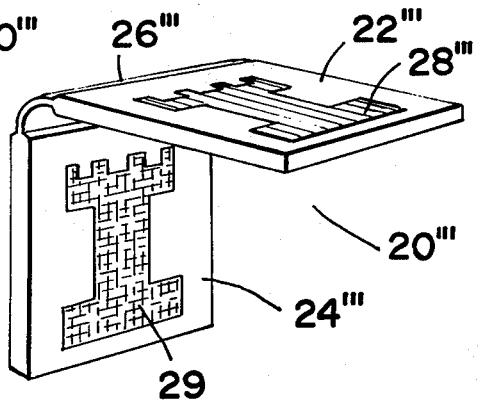
FIG. 10 is a perspective view of a game piece as shown in FIGS. 2–4, 8 and 9 but illustrating a system of applying indicia to the game pieces by which each game piece can bear indicia of two different colors.

Referring to FIGS. 8, 9 and 10 certain details of the game pieces 20 according to this embodiment of the apparatus of this invention are shown. Thus, referring to FIGS. 8 and 9, it will be understood that the rigid bodies 22 and 24 of the game pieces are essentially transparent so that the color of the playing field on which the game piece is placed may be seen therethrough even though such bodies have transverse dimensions substantially equal to the transverse dimensions of the playing fields. FIGS. 8 and 9 are front views of two different game pieces 20′ and 20″, each having a different color indicia thereon. Thus, in FIG. 8, the body 22′ of the game piece 20′ is shown as having a black figure 28′ thereon, whereas in FIG. 9, the body 22″ of the game piece 20″ is shown as having a white figure 28″ thereon. In order to enable the black figure 28′ of the game piece 20′ to be seen when the game piece 20′ is placed on a black playing field, the black figure 28′ is outlined in white. Similarly, in order to enable the white figure 28″ of the game piece 20″ to be seen when the game piece 20″ is placed on a white playing field, the white figure 28″ is outlined in black.

Referring to FIG. 10, it will be understood that the indicia or figures used on the game pieces 20 need not have the same colors as the colors of the playing field. Furthermore, the game pieces 20 may have different colored indicia or figures on opposite faces of the bodies 22 and 24 thereof and the hinge member 26 may be flexible enough to allow the game pieces to be turned inside out in order to select the desired color of indicia or figure. Thus, the game piece 20''' shown in FIG. 10 may have red indicia or figures 28''' on the exterior faces of the bodies 22''' and 24''' as shown in FIG. 10. The interior faces of the bodies 22''' and 24''' may be provided with yellow figures or indicia 29, for example, and the hinge member 26' may be sufficiently flexible to allow the interior and exterior surfaces of the bodies 22''' and 24''' to be reversed as desired.

Figure 11:
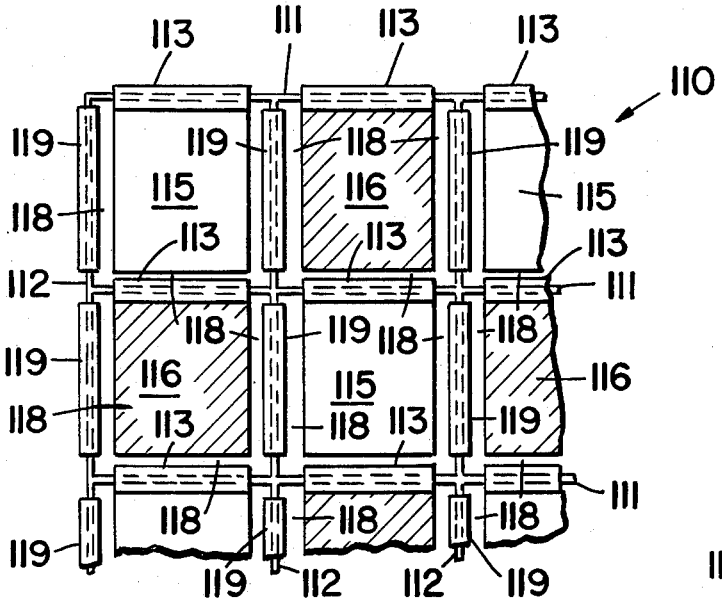
FIG. 11 is an enlarged fragmentary front view in elevation of the upper left hand corner of a game board according to a different embodiment of the apparatus of this invention.
Figure 12:
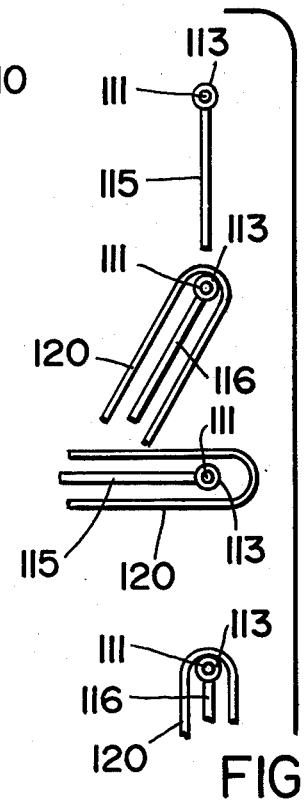
FIG. 12 is a fragmentary cross-sectional view of a game board as shown in FIG. 11 with three game pieces according to this embodiment of the apparatus shown in cross-section two of such game pieces being shown as already applied to the game board and the third of such pieces being shown in the process of being applied to the game board.

Referring to FIGS. 11 and 12, an alternate preferred embodiment of the game apparatus of this invention is shown in which the playing fields are swingably mounted for engagement by rigid U-shaped game pieces. Thus, as shown in FIG. 11, the game board 110, according to this embodiment of the invention, may comprise a first parallel array of a plurality of horizontal wires or rods 111 interconnected by a second parallel array of a plurality of vertical wires or rods 112 to form a mesh having large generally square openings. Rigid playing fields or squares of two different colors 115 and 116 are suspended in such openings in a checkerboard array by means of tubular hinge members 113. Thus, each of the playing fields 115 and 116 has a tubular hinge member 113 rigidly fixed along one side thereof and the horizontal wires or rods 111 of the mesh are received through such hinge members 113 with a loose fit. The dimensions of the playing fields 115 and 116 are slightly smaller than the dimensions of the openings defined by the horizontal 111 and vertical 112 wires or rods. Thus, when the playing fields 115 and 116 are suspended within such openings by the hinge members 113 along one side thereof a space or opening 118 is provided between the other three sides of each playing field 115 and 116 and the adjacent parts of the game board structure. As best shown in FIG. 12, this allows the playing fields 115 and 116 to swing on the hinge members 113 thereof about the horizontal wires or rods 111.

As shown in FIG. 12, the game pieces 120 used with the game board 110 according to this embodiment of the invention are preferably rigid members of U-shape cross-section. Such game pieces 120 may be substantially identical to the game pieces 20 as shown and described in connection with the embodiment of this invention shown in FIGS. 1 through 10, except that the flexible hinge member 26 is not required. Instead, the necessary flexibility is supplied in the game board 110 by means of the tubular hinge members 113 mounting the playing fields 115 and 116. Thus, as shown in FIG. 12, the playing fields 115 and 116 will swing about the horizontal wires or rods 111 in order to enable the application of the game pieces 120 to the game board 110 and their removal therefrom in play. As shown in FIG. 11, tubular rollers 119 may be mounted about the vertical wires or rods 112 between the horizontal wires or rods 111 in order to facilitate the application and removal of the game pieces 120.

Figure 13:
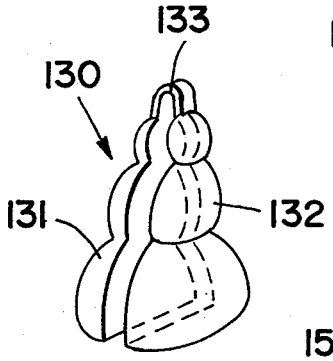
FIG. 13 is a perspective view of a three-dimensional game piece according to the embodiment of this invention shown in FIGS. 11 and 12.

In view of the flexibility of the playing fields 115 and 116 provided by the hinge members 113, it is possible to use three dimensional game pieces 130 as shown in FIG. 13 with the game board 110 according to this embodiment of the invention. Thus the three dimensional game piece 130 may comprise a conventional chess man, for example, which has been split vertically into two halves 131 and 132. The two halves 131 and 132 are then joined at their upper ends in spaced parallel relation by a rigid member 133 to provide a slotted three dimensional game piece for engagement with the playing fields of the game board 110.

Figure 14:
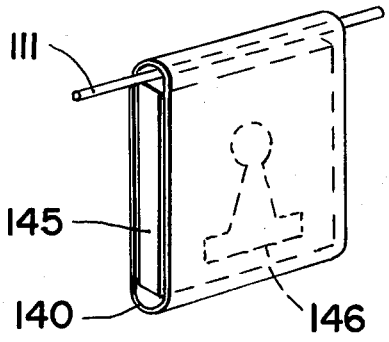
FIG. 14 is a fragmentary view showing an alternate means of construction for the playing board according to the embodiment of this invention shown in FIG. 11.

The playing fields 115 and 116 may be mounted on the horizontal wires 111 of the playing board 110 according to this embodiment of the invention in many ways to provide the required flexibility in such mounting. Thus, as shown in FIG. 14, a plurality of loops 140 of flexible or rigid transparent material may be mounted on the horizontal wires 111. Such loops may provide double walls having transverse dimensions slightly smaller than the openings formed between the horizontal wires 111 by the vertical wires 112 and rigid squares or playing fields 145 of the desired colors may be inserted in the loops 140 between the double walls thereof. Thus, the required flexibility is provided in the game board 110 by the swinging movement of the playing fields 145 about the horizontal wires 111 and any pattern of colors of playing fields may be formed and easily changed. In fact, as indicated by the dotted figure 146, the major surfaces of the squares 145 could bear indicia, thus providing game pieces. In this case the loops 140 could be made of translucent material of selected colors to preserve the checkerboard feature of the array and still enable the indicia 146 on the squares 145 to be seen in play.

Figure 15:
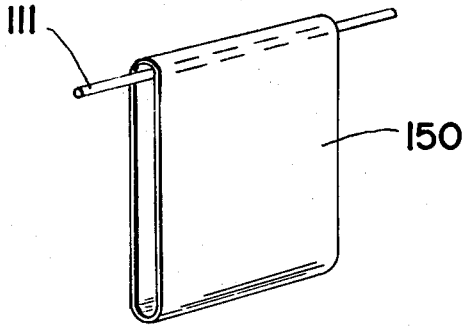
FIG. 15 is an enlarged fragmentary perspective view of a further means of construction for a game board similar to that shown in FIGS. 11 and 14 but adding a further feature of flexibility.
Figure 16:
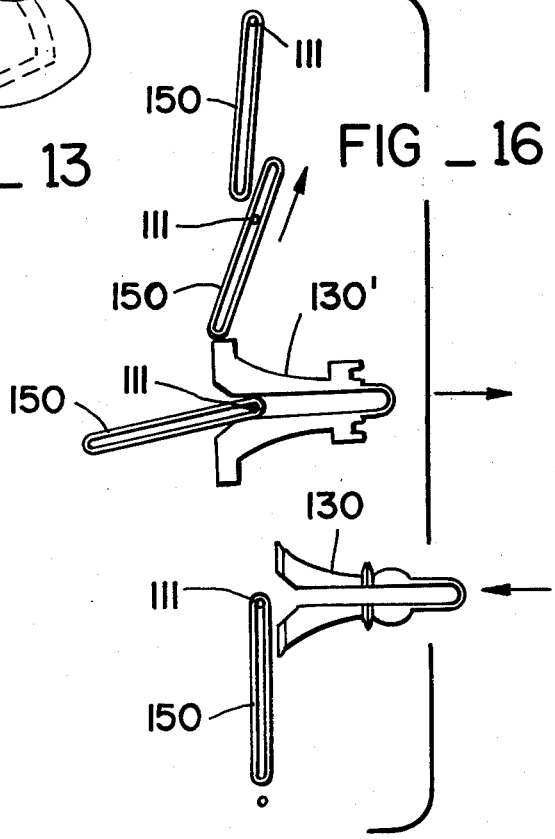
FIG. 16 is a fragmentary cross-sectional view of the playing board constructed as shown in FIG. 15 including a cross-sectional view of two game pieces similar to that shown in FIG. 13 in the process of being applied to the game board in order to illustrate the further feature of flexibility provided according to this construction.

Referring to FIGS. 15 and 16, a further game board structure according to this embodiment of the invention is shown which is particularly suited for use with three dimensional game pieces of the type shown in FIG. 13. According to this structure loops 150 of rigid material and the desired opaque color are mounted on the horizontal wires 111. Again, the loops 150 have transverse dimensions slightly smaller than the openings formed between the horizontal wires 111 by the vertical wires 112. The loops 150 can, of course, swing about the horizontal wires 111 as described hereinabove in connection with FIGS. 11, 12 and 14. However, as shown in FIG. 16, the rigid loops provide an additional element of flexibility which is useful in the application and removal of three dimensional game pieces.

Thus, as shown in FIG. 16, the loop 150 providing the playing field to which a three dimensional game piece 130 is to be applied will swing about the horizontal wire 111 upon which it is mounted. In addition, the loop 150 providing the playing field immediately thereabove and in the same column can move upwardly from its support by the horizontal wire 111 on which it is mounted to accommodate the game piece 130'. This additional flexibility is particularly useful in removing three dimensional game pieces from the game board, it being understood that the loops 150 will always return to their normal position as supported on the horizontal wires 111 when the insertion or removal of a game piece has been completed.

Figure 17:
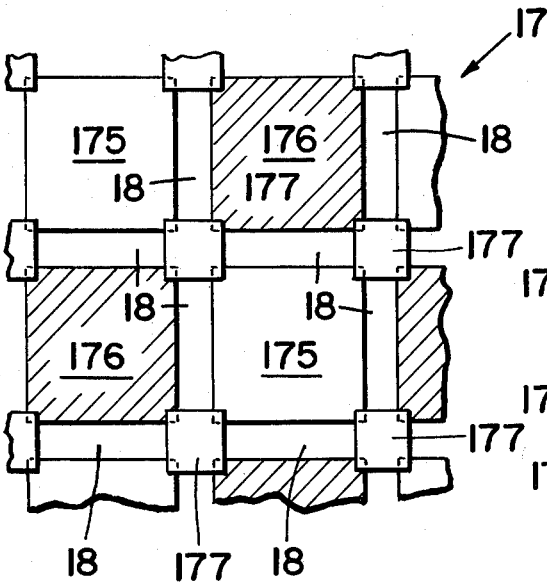
FIG. 17 is an enlarged fragmentary front view of the upper left hand corner of a game board according to yet another embodiment of the apparatus of this invention.
Figure 18:
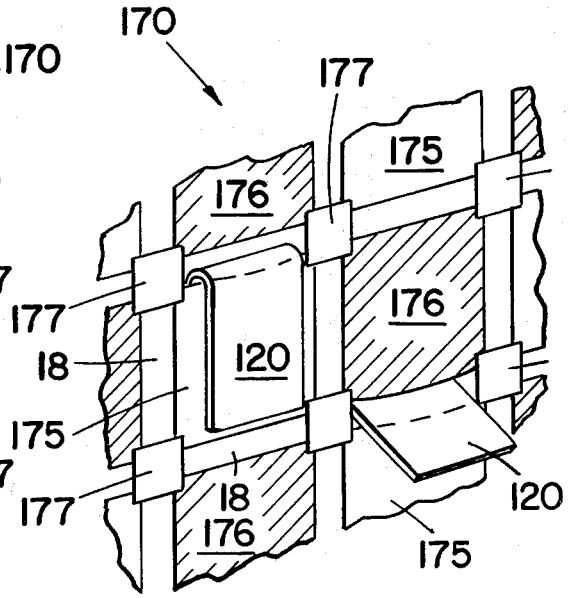
FIG. 18 is an enlarged fragmentary view in perspective of the game board of FIG. 17 showing two game pieces according to this embodiment of the apparatus of this invention with one of such game pieces being shown as applied to the game board and the other of such game pieces being shown in the process of being applied thereto.

Referring to FIGS. 17 and 18, yet another embodiment of the game apparatus according to this invention is shown in which still another structure is used to provide the required flexibility for the application to and removal from the game board 170 of the game pieces. The structure of the game board 170 of FIGS. 17 and 18 is similar to that shown in FIG. 7 and described hereinabove except that the playing fields of the desired colors 175 and 176 are made of flexible material. In addition, the mounting squares 177 interconnecting the corners of the playing fields 175 and 176 may be made of a flexible material. Thus, game pieces 120 of U-shape cross-section similar to those shown in FIG. 12 and described hereinabove may be readily applied to and removed from the game board 170 due to the flexibility of the playing fields 175 and 176 and the mounting squares 177. The game pieces 120 for use with the game board 170 should be thin and light in weight and the game board 170 may be removably mounted within a frame or otherwise supported for use in play. Thus, the game board 170 has the advantage that it can be folded for storage with the game pieces 120 in place.

Figure 19:
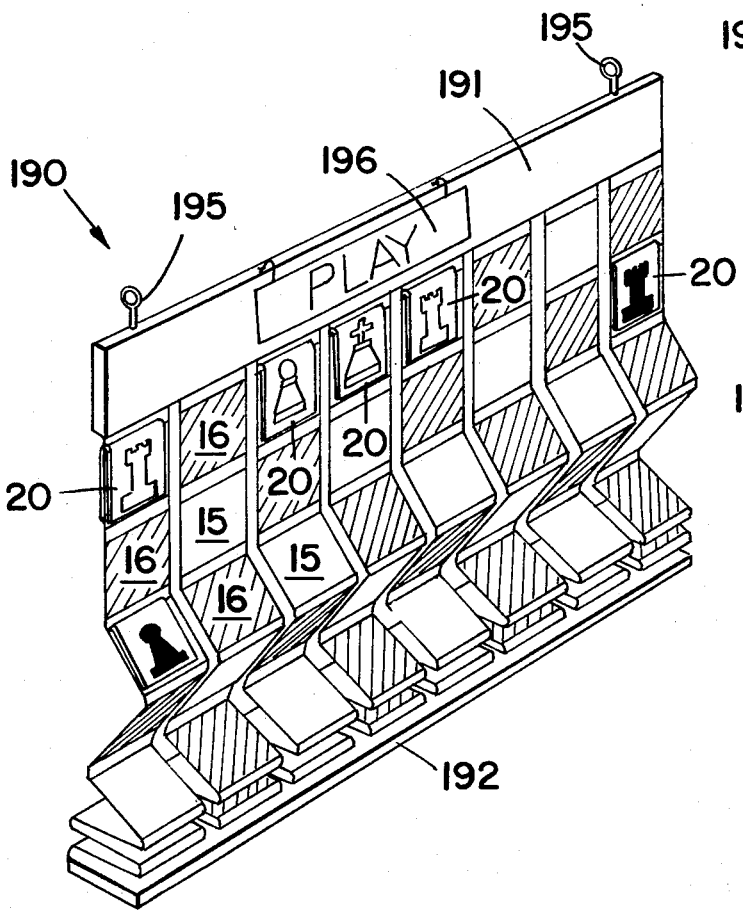
FIG. 19 is a perspective view of a game board similar in construction to that shown in FIG. 6 with a plurality of game pieces similar to that shown in FIGS. 2–4 and 8–10 applied thereto with the game board being modified to allow it to be folded with the game pieces in place.
Figure 20:
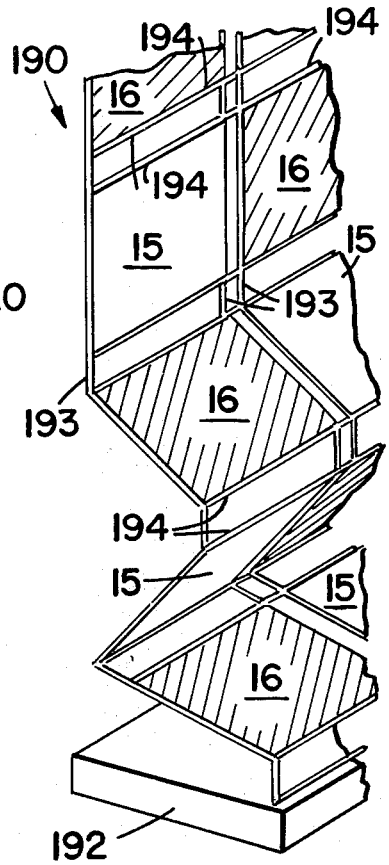
FIG. 20 is an enlarged fragmentary perspective view of an alternate construction of the game board shown in FIG. 19.

Referring to FIGS. 19 and 20, another foldable embodiment of the game apparatus according to the teaching of this invention is shown. The embodiment of FIGS. 19 and 20 is similar to the embodiment of FIGS. 1 through 10 in that game pieces identical to game pieces 20 are utilized in play and in that rigid playing fields 15 and 16 are used to form game board 190 according to this embodiment of the invention. However, the interconnections between the playing fields 15 and 16 are flexible and instead of being mounted within frame, the playing fields 15 and 16 are suspended in spaced relation to each other between upper and lower support bars 191 and 192. For example, as best shown in FIG. 20, the playing fields 15 and 16 of the playing board 190 according to this embodiment of the invention, may be attached to each other in spaced relation by means of elongated vertical 193 and horizontal 194 flexible strands or strings extending along and affixed to the edges of the playing fields as by gluing, for example. The strands or strings 193 and 194 extend from top to bottom and for the full width respectively of the game board 190. The upper and lower ends of the strands 193 are fastened to the upper 191 and lower 192 support bars, respectively.

Thus, it will be seen that the game board 190 may be suspended in a vertical position for play by appropriate hook and eye means 195 affixed to the upper support bar 191, for example. However, the game board 190 may be folded as shown in FIGS. 19 and 20 with or without the game pieces 20 in place thereon for transportation and storage.

As shown in FIG. 19, the game board 190 includes a further feature which is applicable to all embodiments of this invention. Such feature comprises the play notice board 196 mounted on the upper support bar for selective movement from a first position on one side of the upper support bar 191 to a second position on the opposite side of the upper support bar 191. The play notice board 196 may have the word "Play", for example, or any other appropriate indicia on its opposite surfaces. Since the players are on opposite sides of the game board 190 and since the game board 190 effectively prevents the players from seeing each other, the play notice board 196 is useful in notifying or reminding the appropriate player that it is his turn to play. Thus, upon completing a play, each player will move the play notice board 196 from its position on his side of the playing board 190 to its position on the opposite side of the playing board 190 to signify that he has completed his play and it is now the other player's turn.

Figure 21:
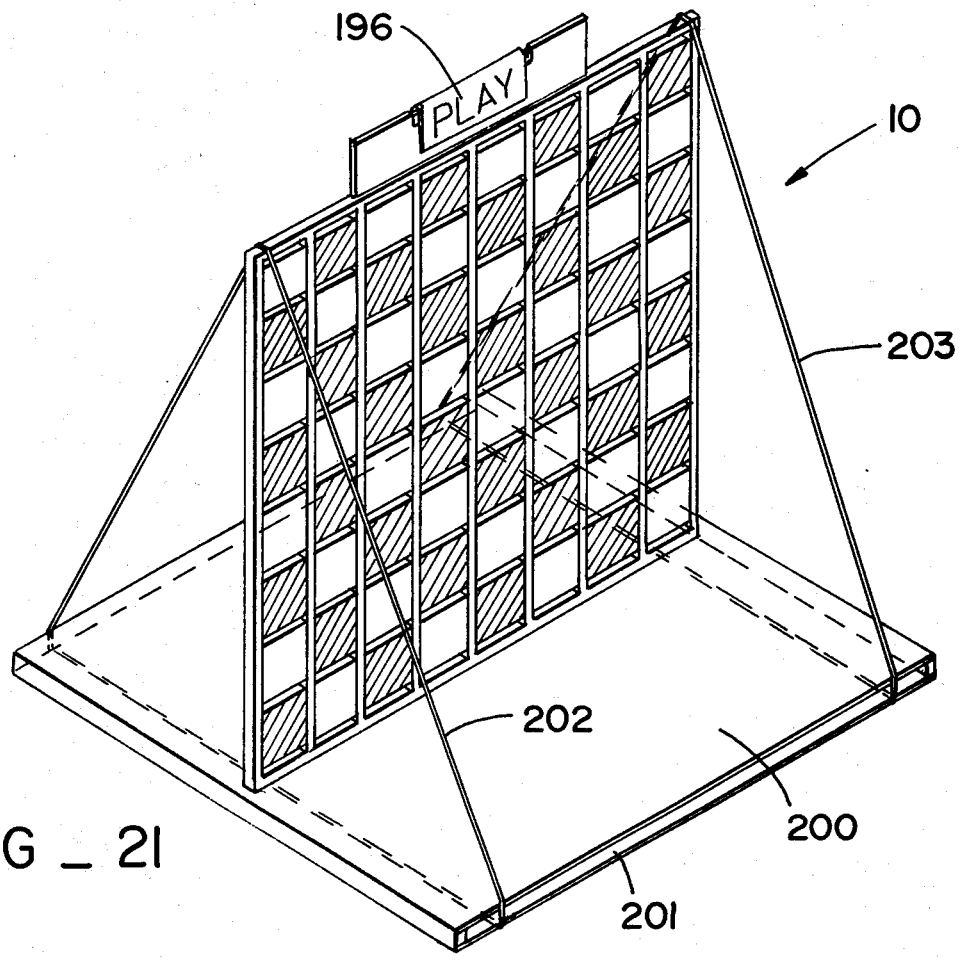
FIG. 21 is a perspective view of a preferred combination package and support means for game apparatus according to the embodiment of this invention shown in FIGS. 1 through 10.

Referring to FIG. 21, a means providing both for the support of a playing board according to the embodiment of this invention shown in FIGS. 1 through 10 and for its storage is shown. Such means comprises a hollow box 200 open along one of its edges 201 and dimensioned to receive the game board 10 therewithin. A pair of straps or cords 202 and 203 are provided which have a length sufficient to extend about the box 200 and over the upper edge of the game board 10 when the box 200 is positioned horizontally and the game board 10 is positioned vertically on the upper surface of the box 200 as shown in FIG. 21. The straps or cords 202 and 203 may be made adjustable in length but need not be resilient. The proper tensioning of straps or cords 202, 203 of approximately the correct length may be obtained by adjusting the angular orientation of the plane in which such straps or cords 202, 203 extend with respect to the horizontal. It has been found that the arrangement shown in FIG. 21 provides stable support for the game board 10 in use with minimum requirement for storage space. It will be noted that the game board 10 in FIG. 21 has been provided with a play notice board 196 as described in connection with FIG. 19. It will also be noted that game pieces 20, for example, may be left in playing position on board 10 for storage in the box 200 with the board 10.

Figure 22:
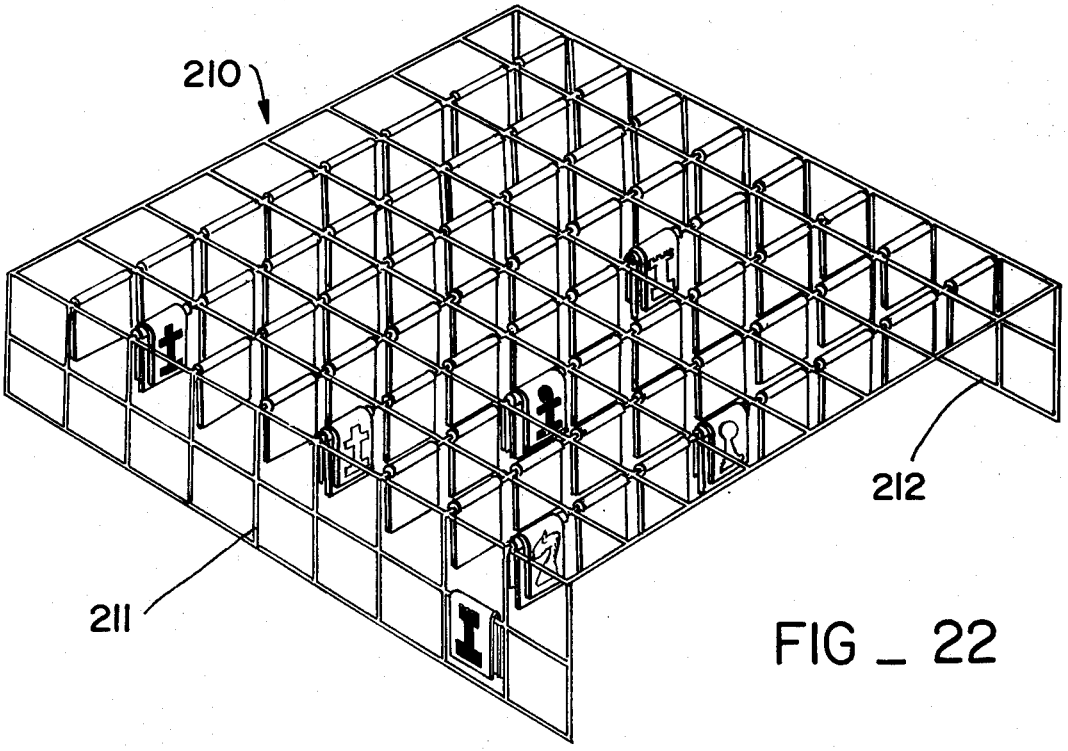
FIG. 22 is a perspective view of a preferred construction for the embodiments of this invention shown in FIGS. 11 through 16 illustrating an alternate playing position for the apparatus according to such embodiments.

Referring to FIG. 22, a modification of the embodiment of this invention shown in FIGS. 11 through 16 is shown which may be played in a horizontal position if desired. Thus, a game board 210 similar to the game board 110 of FIG. 11 is provided with extensions or legs 211 and 212 along opposite sides thereof. Such extensions or legs 211 and 212 may have the same structure as the game board 110 in that they consist of wires or rods extending perpendicularly to each other. The legs 211 and 212 are hinged to the game board 210 and should include at least two columns of openings. Thus the game board 210 may be supported in a horizontal position above a horizontal surface in which position the playing fields thereof will swing to a vertical position as shown. Game pieces 120 or 130 may be used with game board 210 in its horizontal position. However, it would also be possible to use game pieces such as game piece 20 of the embodiment of FIGS. 1 through 10. The legs 211 and 212 will provide a convenient support for playing pieces which have been "taken" or are otherwise not in use on the game board 210.

According to another feature of the game board 210 an extra row of openings is provided in the playing surface. Thus it will be seen that the playing board 210 may be positioned vertically along either of its ends for vertical play with the legs 211 and 212 pivoted to extend on opposite sides thereof for support of the game board 210 in its vertical position. Again, the legs 211 and 212 will provide for the convenient storage of game pieces which are not in use on the game board for whatever reason.

The game apparatus according to the embodiments shown in FIGS. 11–16 may also be played in a conventional manner similar to FIG. 4. Thus, the game boards of FIGS. 11–16 and 22 may be placed on a flat surface with playing fields supported thereby in a common horizontal plane and the playing pieces placed thereon.

From the above detailed description of the drawings it will be seen that the teaching of this invention may be embodied in a number of novel embodiments all of which are preferably utilized with the game board in a vertical position to provide a complete visual shield between the players. When played in a vertical position, the checkerboard feature of the playing board is fully preserved and the possibility of accidental displacement of the game pieces is avoided. It is believed that those skilled in the art will design other embodiments of the game apparatus according to the teaching of this invention differing from those specifically described hereinabove without departing from the scope of this invention.

For example, the game apparatus of this invention may be adapted for games such as backgammon, parchesi, Go or puzzles for example, where the game pieces are of uniform size but the playing fields vary in configuration so long as the required locations of the game pieces are in row and column array. It will be understood that such rows and columns of the array need not include equal numbers of locations for the game pieces in all embodiments of this invention.

Rigid embodiments of the game board of the game apparatus of this invention may be mounted vertically by hinging or otherwise connecting one of its sides to a vertical support such as a wall, in addition to supporting it from the bottom or hanging it from overhead. Thus, the game apparatus may be mounted as a decorator item in a home for space conservation and instant availability for use. It may be made large enough to serve as a partition or small enough to serve as a wall hanging with or without the game pieces mounted thereon. Other embodiments and advantages of the game apparatus of this invention will be obvious to those skilled in the art.

What is claimed is:

1. Game apparatus comprising in combination a game board of given area and thickness and having opposed substantially parallel major surfaces, a plurality of individual slots through said game board defining a given number of playing fields arranged with respect to each other in a planar array of rows and columns of given areas of the opposed major surfaces of said game board, said major surfaces of said playing fields each having an area less than said given area of said array divided by said given number of said playing fields, material disposed between and interconnecting all adjacent corners of said playing fields in said array; and a plurality of game pieces each comprising a pair of indicia bearing bodies, the indicia on a respective one of said pair of indicia bearing bodies of each game piece being the same as the indicia on the respective other one of said pair of indicia bearing bodies of said game piece, and means joining said bodies to each other at one of their ends, said means joining said bodies of each of said game pieces allowing said bodies to extend in mutually parallel planes spaced from each other by a distance at least equal to and not much greater than said given thickness of said game board, at least one of the material forming said interconnected adjacent corners of said playing fields in said array, said means joining said pair of indicia bearing bodies of each of said plurality of game pieces and said plurality of playing fields being flexible.

2. Game apparatus as claimed in claim 1 wherein said game board comprises a rigid hollow generally square frame enclosing a given area and said given number of playing fields are squares made of rigid material and means mounting said given number of playing fields including means interconnecting adjacent corners of said rigid squares with said squares being spaced from each other.

3. Game apparatus as claimed in claim 2 wherein said means interconnecting adjacent corners of said rigid squares comprises a plurality of rigid rods each extending between a pair of adjacent columns of said array with the sides of the rigid squares of said columns fixed thereto, each of said rigid rods being fixed to said frame at its opposite ends and said means joining said bodies of each of said game pieces is flexible.

4. Game apparatus as claimed in claim 2 wherein said means interconnecting adjacent corners of said rigid squares comprises flexible means extending only between adjacent corners of adjacent rigid squares of said planar array.

5. Game apparatus as claimed in claim 2 wherein said means interconnecting adjacent corners of said rigid squares comprises rigid spacer members extending between adjacent corners only of adjacent rigid squares, rigid spacer members extending between said frame and adjacent corners only of said rigid squares and said means joining said bodies of each of said game pieces is flexible.

6. Game apparatus as claimed in claim 2 further including a hollow box dimensioned to contain said rigid frame therewithin, said box being open along one edge thereof to receive said frame, and a pair of elongated inextensible members each having a length substantially equal to the total length of the sides and base of an isosceles triangle having a base equal to a transverse dimension of said frame and an altitude equal to the total of a transverse dimension of said frame plus the thickness of said frame; the ends of each of said pair of elongated inextensible members being joined to form a continuous loop about said frame and said box with said frame extending in a plane perpendicular to the plane in which said box extends, said continuous loops being spaced from each other whereby said frame and said box are fixed with respect to each other and said box may be supported on a horizontal surface with said frame extending vertically thereabove.

7. Game apparatus as claimed in claim 1 wherein said given number of playing fields are individual squares made of rigid material and said game board includes means mounting said rigid squares in said planar array comprising flexible means interconnecting adjacent corners of said rigid squares with said rigid squares being equally spaced from each other in said array and a rigid bar with flexible means interconnecting said bar with corners of said rigid squares in an outside row of said array whereby said array may be hung from said bar.

8. Game apparatus as claimed in claim 1 wherein said planar array extends vertically and the upper end thereof is provided with indicia means movable through an arc extending above said array from a first position on one side of said array to a second position on the opposite side of said array.

9. Game apparatus as claimed in claim 1 wherein each of said pair of indicia bearing bodies of each of said game pieces comprises a rigid planar body having opposed generally parallel major surfaces bearing said indicia and said means joining said pair of indicia bearing bodies of each of said game pieces is flexible.

10. Game apparatus as claimed in claim 9 wherein each of said pair of indicia bearing bodies of each of said game pieces is substantially transparent and said indicia thereon is substantially opaque.

11. Game apparatus as claimed in claim 9 wherein each of said major surfaces of each of said pair of indicia bearing bodies of each of said game pieces bears indicia which is different from that borne by the other major surface thereof but the same as that borne by the corresponding major surface of the other body of such pair; and said means joining said pair of indicia bearing bodies of each of said game pieces is sufficiently flexible to allow said major surfaces of said bodies to be exposed to view in alternate pairs of corresponding major surfaces.

12. Game apparatus as claimed in claim 1 wherein said given number of playing fields are each made of a thin flexible material.

13. Game apparatus comprising a planar game board of given length, width and thickness, a planar support pedestal of given length, width and thickness and an elongated inextensible member having a length substantially equal to the total length of the sides and base of an isosceles triangle having a base equal to said given width of said support pedestal and an altitude equal to the total of said given width of said game board and said given thickness of said support pedestal; the ends of said elongated inextensible member being joined to form a continuous loop about said game board and said support pedestal with the plane of said game board extending perpendicular to the plane of said pedestal whereby said game board and said support pedestal may be fixed to each other by adjusting the plane of said continuous loop formed by said elongated inextensible member with respect to the planes of said game board and said support pedestal to enable said game board to be supported vertically above a horizontal surface upon said support pedestal.

* * * * *